US007055846B2

(12) United States Patent
Restani

(10) Patent No.: US 7,055,846 B2
(45) Date of Patent: Jun. 6, 2006

(54) SKI WITH LATERAL SUPPORT PLATE

(75) Inventor: Eric Restani, Voiron (FR)

(73) Assignee: Skis Rossignol SA, Voiron (FR)

( * ) Notice: Subject to any disclaimer, the term of this patent is extended or adjusted under 35 U.S.C. 154(b) by 128 days.

(21) Appl. No.: 10/722,327

(22) Filed: Nov. 25, 2003

(65) Prior Publication Data

US 2004/0150191 A1 Aug. 5, 2004

(30) Foreign Application Priority Data

Nov. 26, 2002 (FR) ..... 02 15087

(51) Int. Cl.
*A63C 9/00* (2006.01)

(52) U.S. Cl. ..... 280/607; 280/617; 280/11.14; 280/602; 280/608; 280/609

(58) Field of Classification Search ..... 280/607, 280/610, 613, 615, 617, 618, 634, 635, 636, 280/11.14, 11.15, 11.224, 11.225, 602, 608, 280/609, 624, DIG. 12, DIG. 13
See application file for complete search history.

(56) References Cited

U.S. PATENT DOCUMENTS 4,294,460 A * 10/1981 Kirsch ..... 280/607
5,480,175 A * 1/1996 Astier et al. ..... 280/607
5,538,271 A * 7/1996 Abondance ..... 280/602

FOREIGN PATENT DOCUMENTS

| | | |
|---|---|---|
| EP | 0 755 703 | 1/1997 |
| FR | 2670392 | 6/1992 |
| FR | 2675391 | 10/1992 |
| FR | 2726193 | 5/1996 |

* cited by examiner

*Primary Examiner*—Christopher P. Ellis
*Assistant Examiner*—John Walters
(74) *Attorney, Agent, or Firm*—Fay, Sharpe, Fagan, Minnich & McKee, LLP

(57) ABSTRACT

A snow sliding board (1) such as a ski, a snow board or a surf board has a vertical plane of general symmetry (P). A principal portion, called body or base, includes at least in the area of the sole a complementary, longitudinal element intended to receive the binding for retention of the user's boot The base (2) has the shape of an elongated beam, comprising a sliding sole, whose front extremity is raised in order to form a spatula, with the complementary longitudinal element having the shape of an elongated plate, limited laterally by a lateral left rim and a lateral right rim. The complementary element additionally includes a front portion connected to a rear portion by means of a middle portion. At least one of the lateral rims of the complementary element acts as lateral support, via at least its middle portion, on a lateral shock absorbing stop of deformable elastic material.

15 Claims, 7 Drawing Sheets

SKI WITH LATERAL SUPPORT PLATE

BACKGROUND OF THE INVENTION

The present invention relates to a snow sliding board, such as a ski, a mono-ski board, a snowboard, or other. It concerns, more specifically, an improvement relative to a sliding board comprising a base and a complementary element destined to receive the retention binding of the user's boot.

In recent years, sliding sport practice has gradually undergone adaptation and evolution. Persons practicing said sport are making ever increasing demands with respect to product quality. This is the true, for example, in the case of the sport of sliding on slow.

A great number of sliding board models are already known and notably skis which are composed of a beam with elongated shape whose front extremity is raised in order to form the spatula, while the lower surface comprises a sliding sole edged by metal squares.

In spite of all efforts developed by equipment builders in order to satisfy their clients, to this day there does not exist any ski which perfectly combines user comfort and satisfactory behavior characteristics on the ski runs, regardless of the type of terrain and category of the user. Certain efforts have been made, such as, for example, by the designs disclosed in French Patents 2 670 392 and 2 675 391. The applicant, by its ski disclosed in French Patent 2 726 193 has already proposed a ski construction according to which a body is provided on which is fixed a sole-piece. However, in spite of the enormous progress contributed by this design, there still is the perception that improvements are possible.

The present invention proposes multi-purpose skis composed of a base and a complementary element, and by cooperation of these, providing the ski ensemble its necessary characteristics insofar as comfort and behavior of the ski is concerned.

SUMMARY OF THE INVENTION

Thus, the snow sliding board according to the invention is of the type which comprises a principal portion, called body or base, which includes, at least in the zone of the sole, on its upper surface, a complementary longitudinal element destined to receive the binding or bindings for retaining the user's boot, said base having the shape of an elongated beam, comprising a sliding sole, whose front extremity is raised in order to form a spatula, with the complementary longitudinal element having the shape of an elongated plate, limited laterally by a left lateral rim and a right lateral rim—additionally, a front portion connected to a rear portion by a middle portion, and being characterized in that at least one of the lateral rims of the complementary element acts in lateral support, at least by its middle portion, on a lateral shock absorbing stop made of elastic deformable material.

According to a specific embodiment, the lateral shock-absorbing stop is fixed on the upper surface of the base.

According to another specific embodiment, the lateral shock-absorbing stop includes a shock-absorbing element, held, sandwich-style, between the lateral rim corresponding to the complementary element and a lateral retainer projection, which is an integral part of the base. Thus the shock-absorbing element of the lateral shock-absorbing stop can be an integral part of the lateral retainer projection or be an integral part of the lateral rim of the complementary element.

According to a preferred embodiment, at least one of the lateral rims of the complementary element contains a hollow profile, constituting in the middle portion of said complementary element, a zone of lesser width, said hollow profile being intended to cooperate with the lateral shock-absorbing stop of complementary shape.

According to a complementary characteristic, the internal lateral rim acts as lateral support on the lateral shock-absorbing stop which is arranged on the internal side of the ski.

According to another characteristic of the preferred embodiment, the front portion of the complementary element is constituted by two longitudinal front arms which extend from the middle portion toward the front, while the rear portion of the complementary element is constituted by two longitudinal rear arms, extending from the middle portion towards the rear.

According to another complementary characteristic, the complementary element is fixed at the base on its upper surface thanks to fixation means, while the front portion and the rear portion of the complementary element are each fixed by fixation means to the base, assuring blockage of relative lateral displacement between said element and the base, and absence of relative longitudinal displacement, while the central portion of the complementary element is fixed to the base by fixation means assuring blockage in longitudinal translation of the complementary element in regard to the base and permitting transverse displacement relative to said element in regard to said base.

Still further advantages of the present invention will be appreciated to those of ordinary skill in the art upon reading and understand the following detailed description.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

FIGS. 1 to 5*e* represent a first specific embodiment of the invention of a right ski.

FIG. 1 is a view from above of the base only without its complementary element.

FIG. 2 is a view from above of the ski, whose base is fitted with its complementary element.

FIG. 3 is a perspective view of the ski prior to placement of the complementary element on the base.

FIG. 4 is a perspective view of the ski with its base fitted with its complementary elements.

FIGS. 5*a*, 5*b*, 5*c*, 5*d*, 5*e* are views sectioned according to A—A, B—B, C—C, D—D, E—E, in enlarged scale of the ski, i.e. of the base equipped with its complementary element.

FIG. 7 is a partial view of the base only with its stop, while FIG. 7*a* is a view in transverse section made at the base stop level with its complementary element.

FIG. 8 is a partial view of the base only with its stop, while FIG. 8*a* is a view is transverse section at the level of the base stop with its complementary element.

DETAILED DESCRIPTION OF THE PREFERRED EMBODIMENTS

Figure 1:
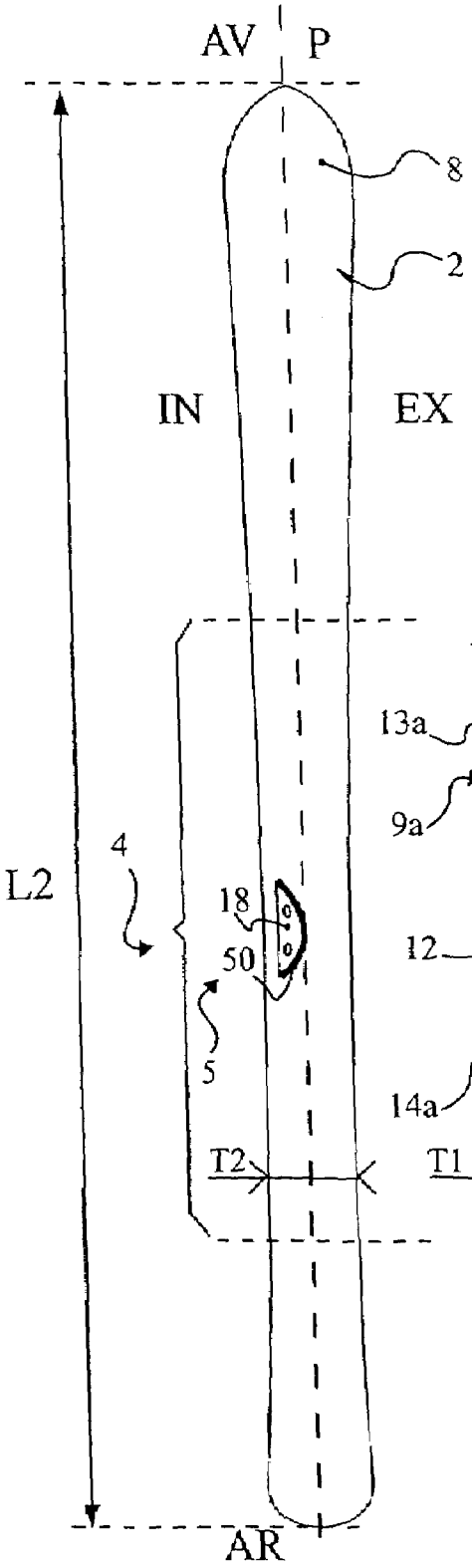
Figure 1A:
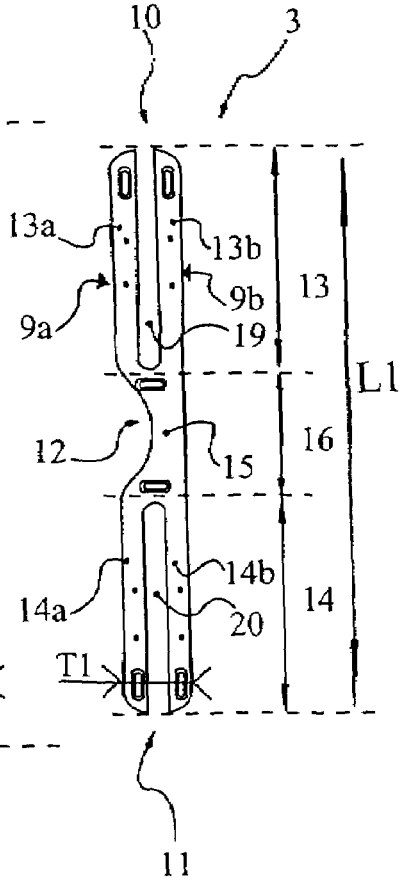
FIG. 1*a* is a view from above of the complementary element alone.
Figure 2:
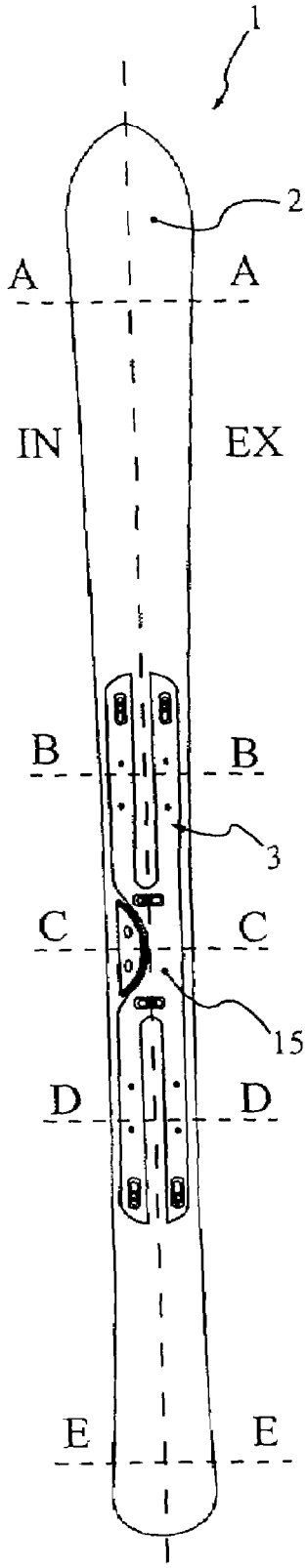

The ski bearing general reference (1) is an ensemble of elongated forms having a longitudinal vertical plane (P), a middle plane of general symmetry, whose front is raised in order to form the spatula (8).

The ski (1) is constituted by a principal portion which will be called the body or the base (2) on the upper surface (17) of same is fixed, at least in the zone of the sole (4), a complementary element (3), destined to receive the binding or bindings (27*a*, 27*b*) for retaining the boot of the user.

The base (2) is the element that is in contact with the snow and has the shape of an elongated beam presenting on its lower surface a sliding sole (6) bordered laterally by lateral metal edges (7*a*, 7*b*).

The base (2) is an elongated beam whose front extremity is raised in order to constitute the spatula (8) of the ski. Said base (2) has its appropriate distribution of thickness, coast line, width and stiffness and can have any kind of structure, any type of geometry or be constituted of any kind of material.

Thus, the elongated beam constituting the base (2) can have all kinds of structures, for example, such as are known to date as sandwich-type, box-type, even mixed type and composed of an ensemble of elements and components known per se.

The complementary element (3) has the shape of an elongated plate comprising two lateral rims (9*a*, 9*b*), extending between a front extremity (10) and a rear extremity (11).

The width (T1) of the complementary element (3), that is to say the width (T1) measured between its lateral rims (9*a*. 9*b*) is less or equal to the width (T2) of the base (2) at the location of the measure. According to a characteristic of the preferred specific embodiment of the invention, the complementary element (3) is such that at least one of its lateral rims (9*a* and/or 9*b*) comprises a hollow profile (12) in such manner that said complementary element includes a front portion (13) connected to a rear portion (14) by means of a middle portion (16) comprising a zone of lesser width (15). It should be noted that the length (L1) of the complementary element (3) is shorter than the length (L2) of the base (2). It should be noted as an example that the length (L1) of the complementary element (3) can comprise between 30% and 70% of the length (L2) of the base (2). Thus, the length (L1) of the complementary element can have, for example, a length ranging between 50 and 120 centimeters.

According to the preferred specific embodiment of the invention, the internal lateral rim (9*a*) which includes the hollow profile (12), is destined to cooperate with the internal shock-absorbing stop, with the lateral internal rim being for a right ski arranged on the left and for a left ski arranged on the right side.

As is the case with the base (2), the complementary element (3) has its appropriate configuration and structure. It has its appropriate distribution of thickness, width and rigidity and can have any kind of construction. Accordingly, said complementary element (3) can be a single block element made of one single type of material. But it can also have any other design, such as, for example, that the front portion (13) is of a different material and/or different design from the rear portion (14) or according to the variation of FIG. 11.

According to the preferred mode of the invention, the lateral retention of the middle portion (16) of the complementary element (3) is realized by support on the lateral shock-absorbing stop (5). According to this mode of realization, the lateral shock-absorbing stop (5) is made up of a shock-absorbing element (50) which is an integral part of a lateral retention projection (18) fixed at the base (2). Said lateral retention projection (18) is arranged at the level of the hollow profile (12) of the complementary element (3). It is fixed at the base by any appropriate means such as screws or glue, even welding or other means. In addition, it includes an external wall which is approximately flat and an internal wall beneficially rounded, covered with a layer of shock-absorbing material, which is elastically deformable, constituting the shock-absorbing element (50) which, in cooperation with the projection constitutes the internal shock-absorbing projection (5). It is evident that cooperation of shape between the lateral shock-absorbing stop (5) and the hollow profile (12), said components being of complementary shapes, also permits longitudinal retention of the complementary element.

According to the specific embodiments represented in FIGS. 1 to 10, the front portion (13) of the complementary element (3) is composed of two longitudinal front arms (13*a*, 13*b*) which extend from the middle portion (16) towards the front (10). Likewise, the rear portion (14) of the complementary element (3) is composed of two longitudinal rear arms (14*a*, 14*b*) extending from the middle portion (16) toward the rear (11).

Thus, the front portion (13) includes an internal front arm (13*a*) and an external front arm (13*b*), which extend parallel to the external front arm and is separated from the latter by a longitudinal front space (19). Likewise, the rear portion (14) comprises an internal rear arm (14*a*) and an external rear arm (14*b*) which extend parallel to the external rear arm and is separated from the latter by a longitudinal rear space (20).

The complementary element (3) is fixed at the base on its upper surface, thanks to fixation means which can be of any kind, but which, according to the specific embodiment provided by way of an example, are constituted by fixation screws. Thus, according to the preferred specific embodiment, the front portion (13) and the rear portion of the complementary element (3) are each fixed at the base by fixation means, assuring blockage of lateral relative displacement between said element and the base, and absence from relative longitudinal displacement.

In addition, the central portion (16) of the complementary element (3) is fixed at the base by means of fixation, assuring blockage in longitudinal translation of the complementary element in regard to the base and permitting relative transverse displacement of said element in regard to said base.

Thus, the front portion (13) of the complementary element is fixed at the base by means of two fixation screws, one front left screw (21*a*) and one front right screw (21*b*) each of the screws traversing a corresponding oblong hole, respectively extending through an oblong left hole (22*a*) and an oblong right hole (22*b*). Likewise, the rear portion (14) of the complementary element is fixed at the base by means of two fixation screws, one left rear screw (23*a*) and one right front screw (23*b*), each of the screws traversing through a corresponding oblong hole, respectively extending longitudinally through a left oblong hole (24*a*) and an oblong right hole (24*b*).

In addition, the central portion (16) of the complementary element (3) is fixed at the base, for example by two screws (25*a*, 25*b*) each traversing a corresponding oblong hole (26*a*, 26*b*) extending in transverse manner. The screws (25*a*, 25*b*) can be positioned in the center of the corresponding oblong hole (26*a*, 26*b*) in order to permit lateral displacement on both sides of the screws (25*a*, 25*b*) of the central portion (16). But these screws could be in contact with one of the extremities of the oblong holes (26*a*, 26*b*) in order to allow lateral displacement on only one side, and, more precisely, the lateral support side (5).

Figure 6:
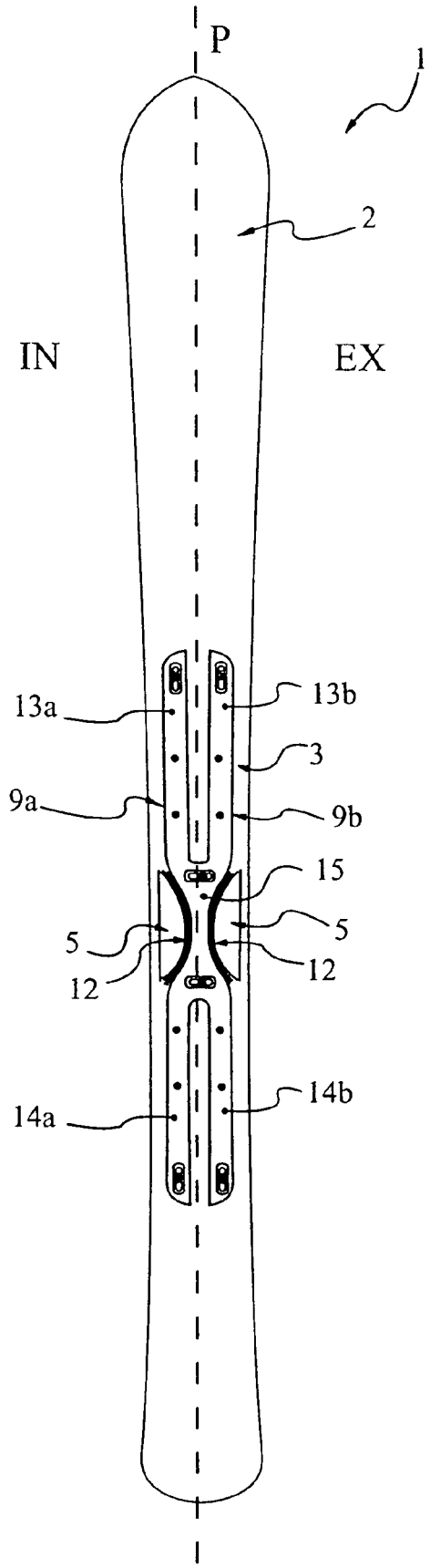
FIG. 6 is a view from above depicting a variation in design.

FIG. 6 is a view from above depicting an execution variation according to which the complementary element (3') and, particularly its middle portion (16) and, more specifically its hollow lateral profile (12) gives lateral support by its two lateral rims, on a lateral shock-absorbing stop (5). Thus, the base (2) comprises two lateral shock-absorbing stops, one of the internal side and one of the external sides. Of course, the design of the ski could be such that the complementary element (3) might only be laterally supported against a shock-absorbing stop on its external side.

Figure 7:
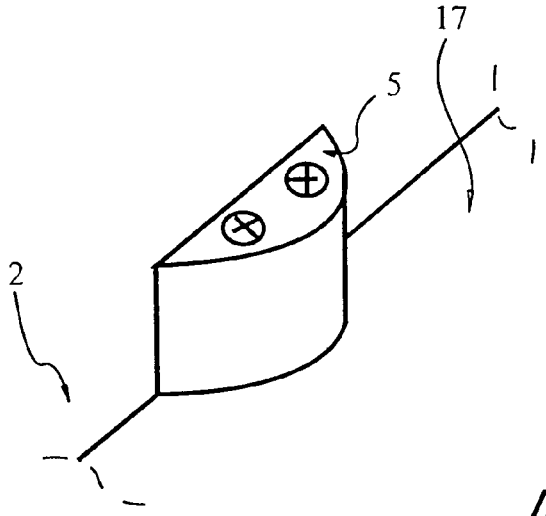
FIGS. 7 and 7*a* represent an embodiment variation of the lateral shock-absorbing stop.
Figure 7A:
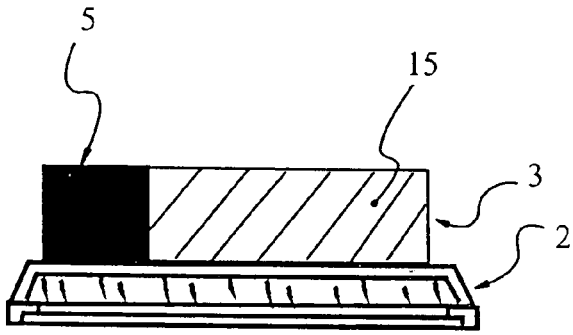

According to the specific embodiments illustrated in FIGS. 1 to 6 and 8 and 8*a*, the shock-absorbing stop (5) is composed of a shock-absorbing element (50), which is an integral part of a lateral retention projection (18) fixed at the base (2); but the reverse could also be the case. The shock-absorbing stop (5) could thus be a single block piece which is made of deformable elastic material, fixed at the base, which is illustrated in FIGS. 7 and 7*a*.

Figure 8:
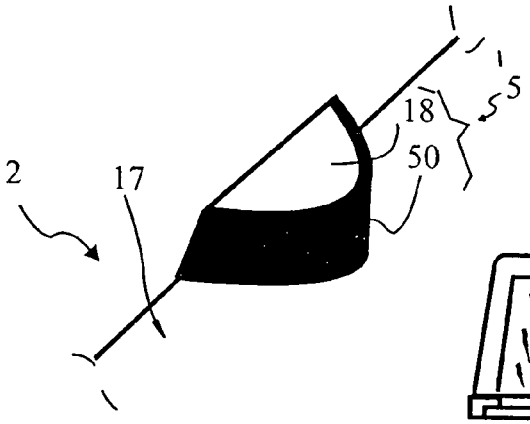
FIGS. 8 and 8*a* represent another embodiment variation of the lateral shock-absorbing stop.
Figure 8A:
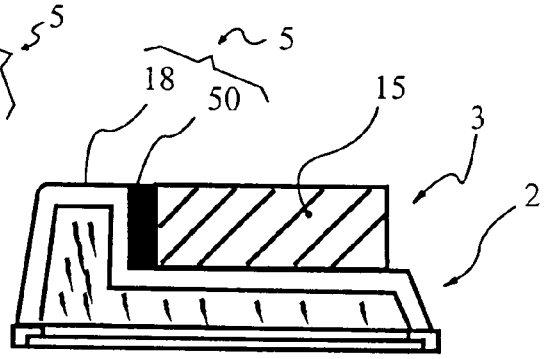

It should also be noted that the lateral retention projection (18) which, according to the above described specific embodiment, is a piece which is separate from the base on which it is fixed, could be an integral part of the base, as illustrated in FIGS. 8 and 8*a*; a projection against which the shock-absorbing element would be fixed, for example, by glue, welding or other means.

Figure 3:
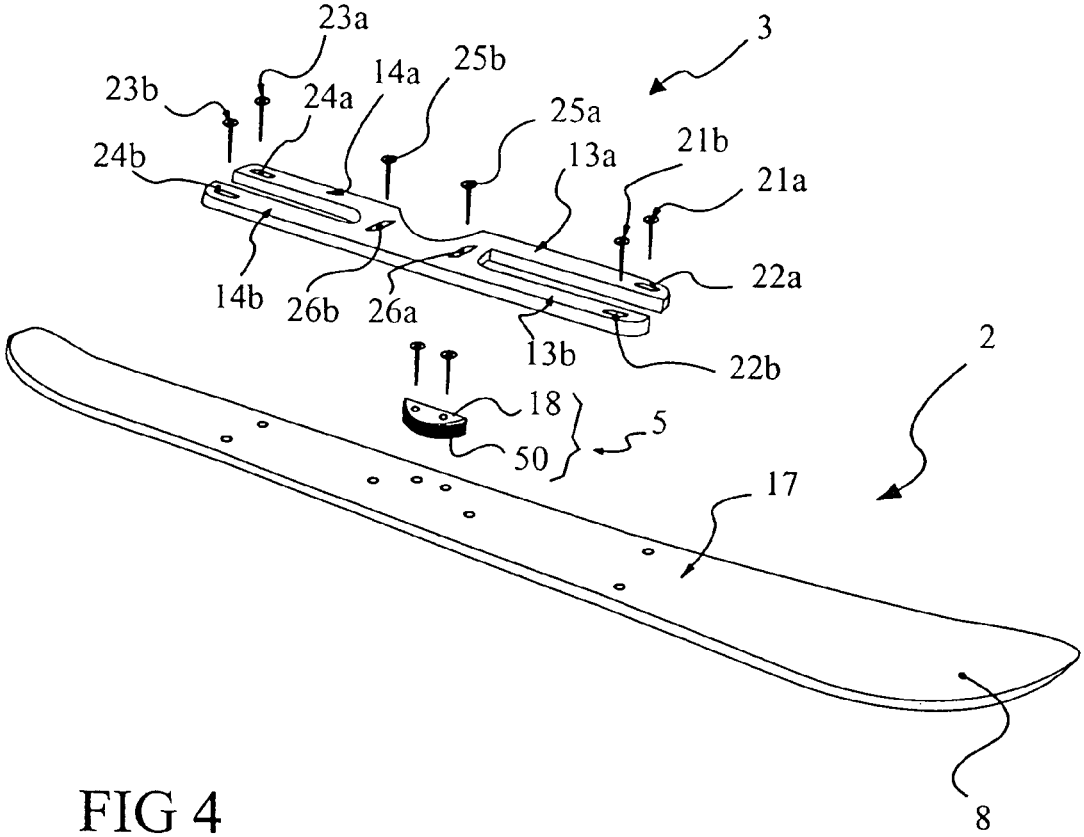
Figure 4:
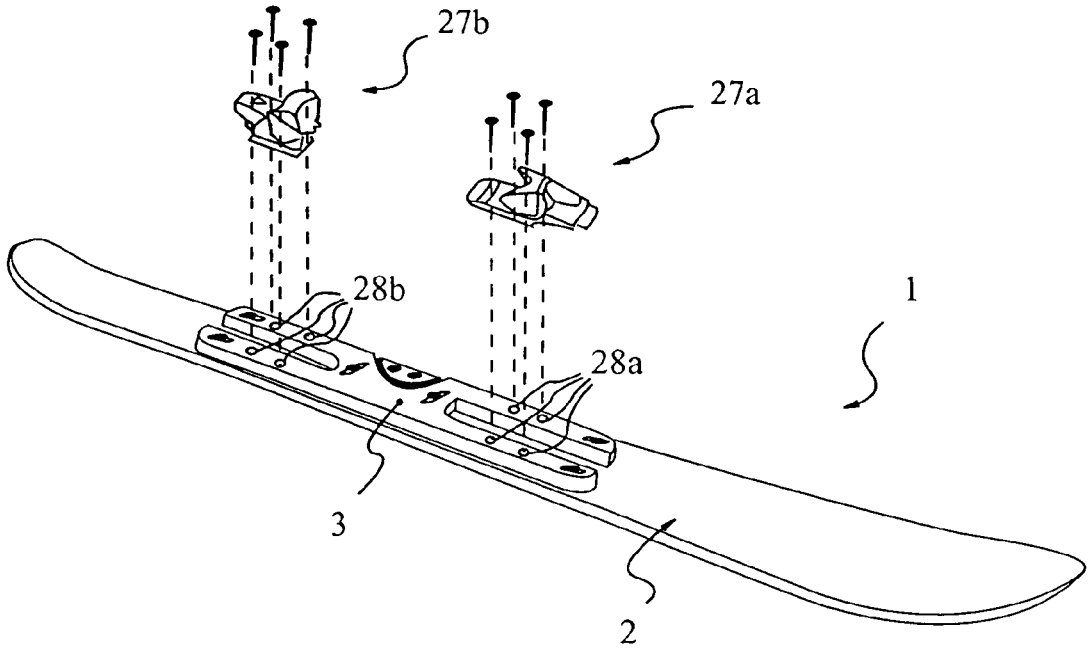
Figure 5A:
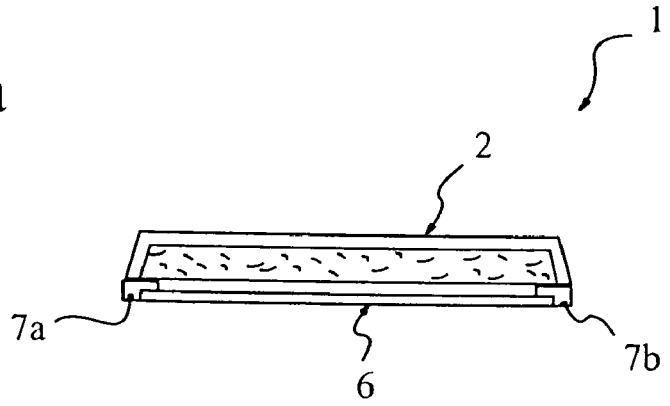
Figure 5B:
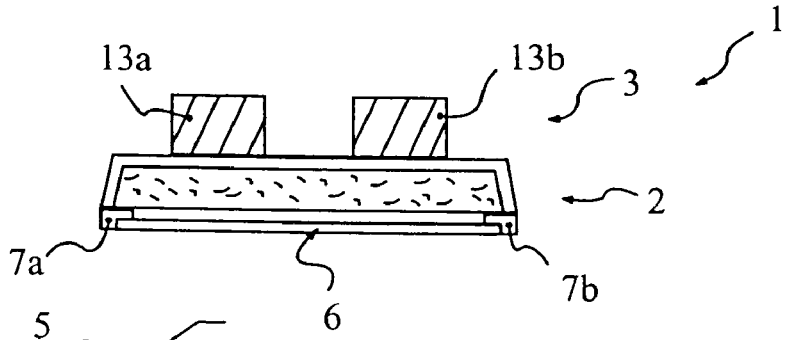
Figure 5C:
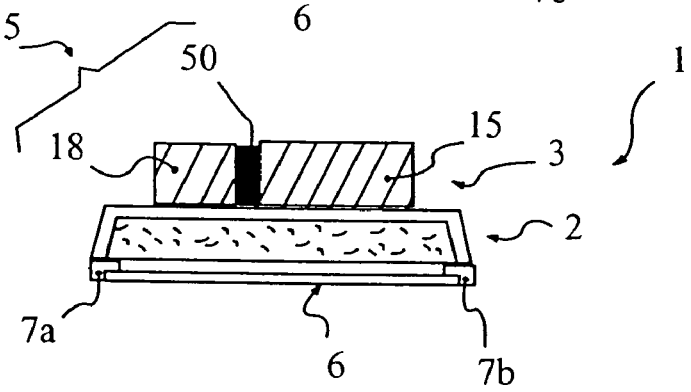
Figure 5D:
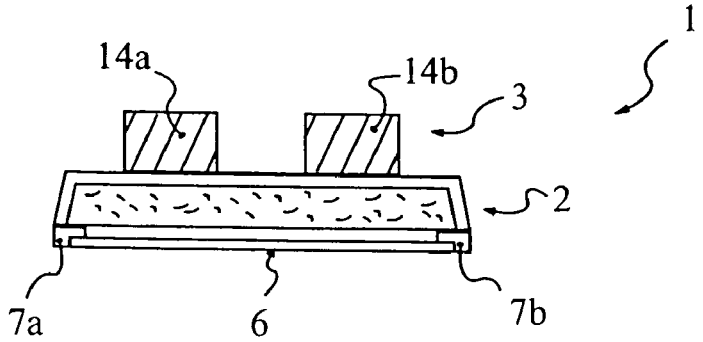
Figure 5E:
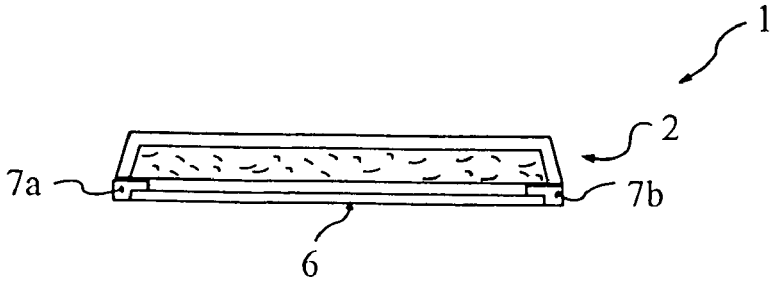
Figure 9:
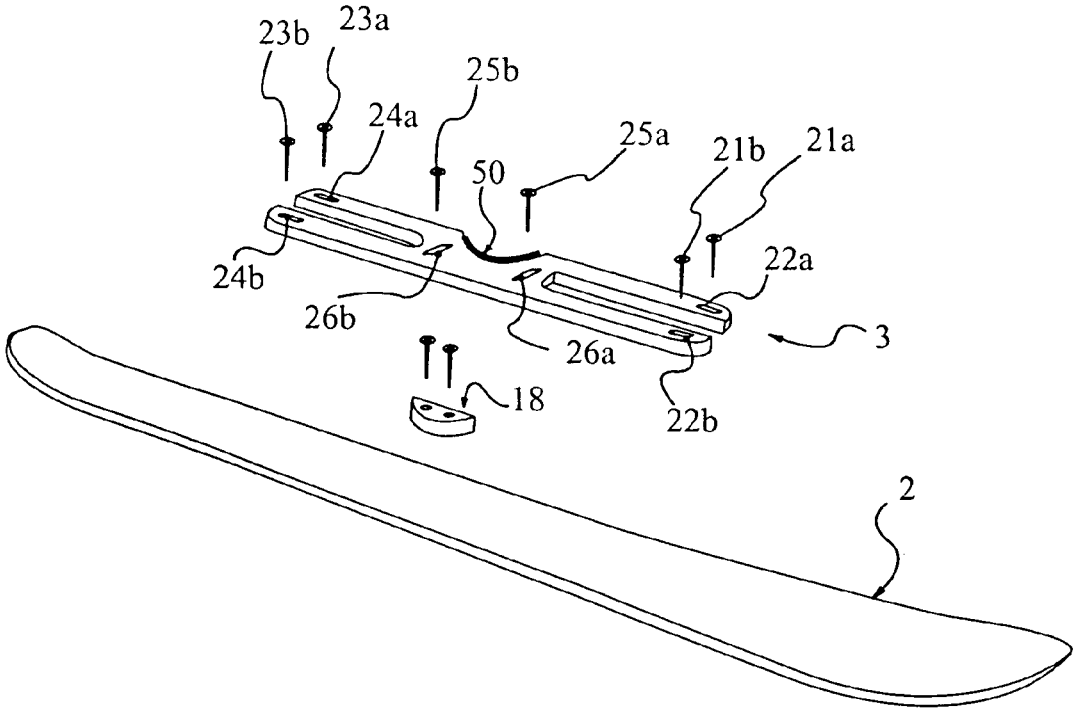
FIG. 9 is a view similar to FIG. 3 depicting a variation in design.

FIG. 9 is a similar view as FIG. 3, illustrating an execution variation according to which the shock-absorbing element (50) is connected to the complementary element (3) by being glued, for example, on the lateral rim of the hollow lateral profile (12) realized in the middle portion, while the lateral retention projection (18) is connected to the base (2) or is an integral part thereof.

According to the specific embodiments illustrated in FIGS. 1 to 9, the complementary element rests against the lateral shock-absorbing stop by at least its middle portion. Thus the lateral shock-absorbing stop is localized at the level of the middle portion (16) of the complementary element (3) so as to cooperate with the hollow profile (12) which is localized there, but the lateral shock-absorbing projection could extend toward the front and/or towards the rear, so as to extend beyond the zone of the hollow profile (12) and to retain also laterally by shock absorption the lateral rim (9*a*, 9*b*) of the front portion (13) and/or of the lateral rim (9*a*, 9*b*) of the rear portion (14) of said complementary element (3).

Figure 10:
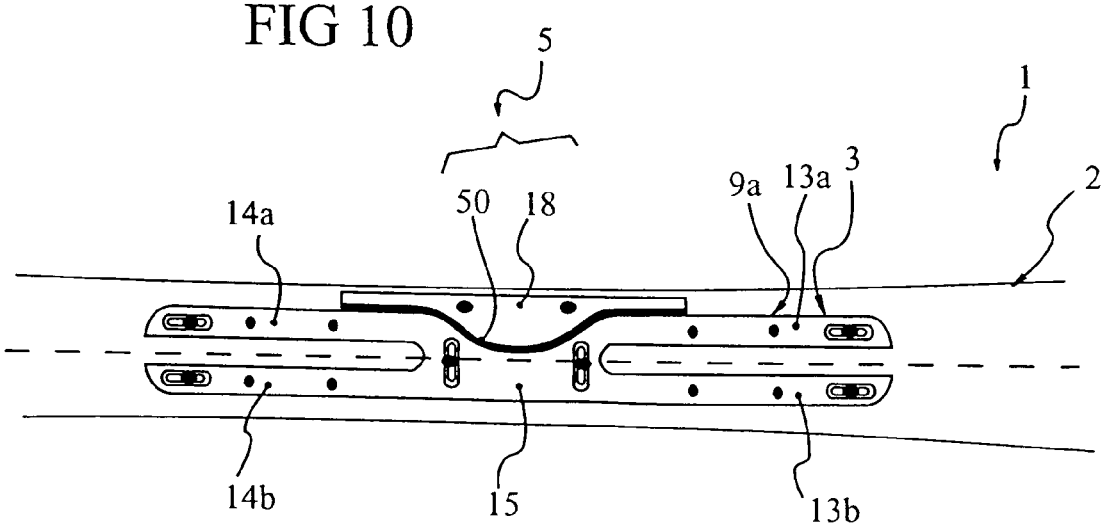
FIG. 10 is a view similar to FIG. 2 illustrating another variation in design.

FIG. 10 shows an example of such variation where the internal side of the ski (1) is such that the complementary element (3) is laterally retained by a lateral shock-absorbing stop (5) which extends from the central portion of lesser width toward the front and the rear in order to laterally retain by shock absorption the lateral rim (9*a*) of the front portion (13) and the lateral rim (9*a*) of the rear portion (14) of said complementary element (3).

Figure 11:
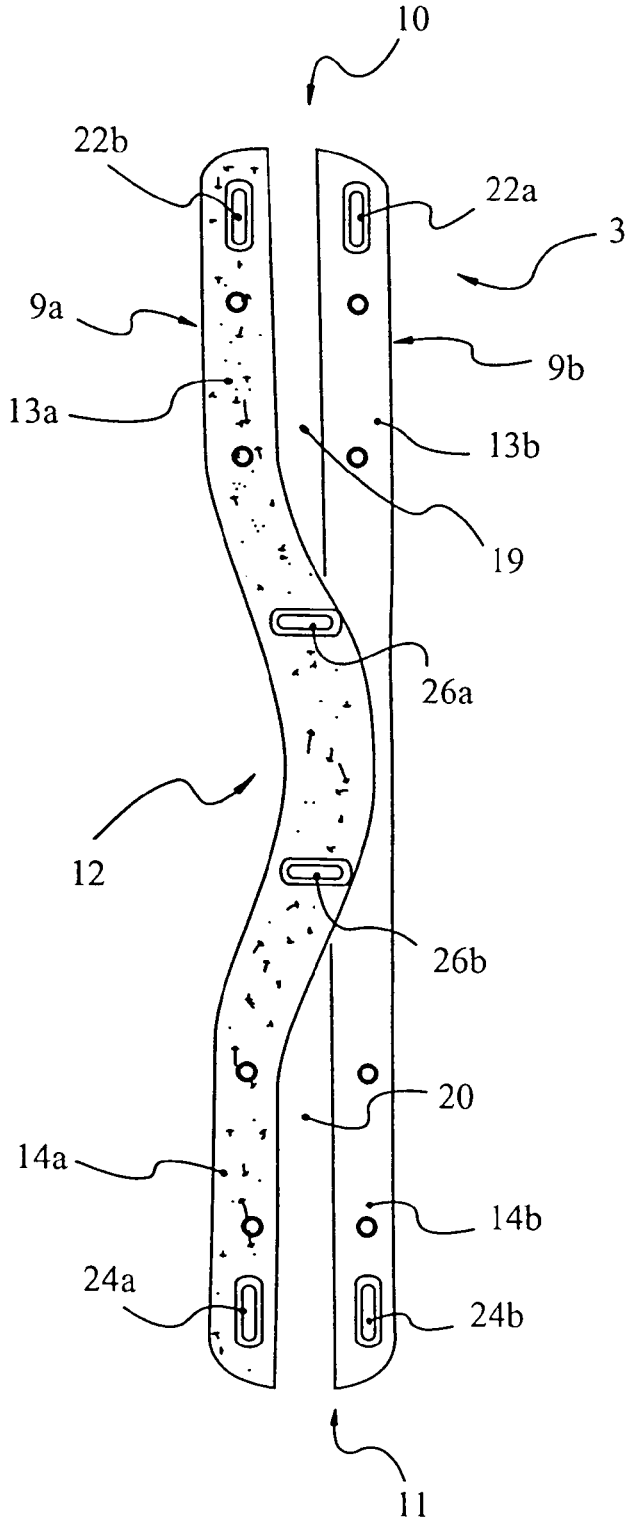
FIG. 11 is a view from above of a design variation of a complementary element.

FIG. 11 is a view from above of a realization variation of a complementary element. According to said variation, the front internal arm (13*a*) and the rear internal arm (14*a*) are realized, together with the middle portion (16) with a first material (M1) whereas the front external arm (13*b*) and the rear external arm (14*b*) are realized with a second material (M2), which is different from the first material (M1). Said materials can be, for example, a charged polyamide, or a thermoplastic elastomer, or any other appropriate material.

Figure 12:
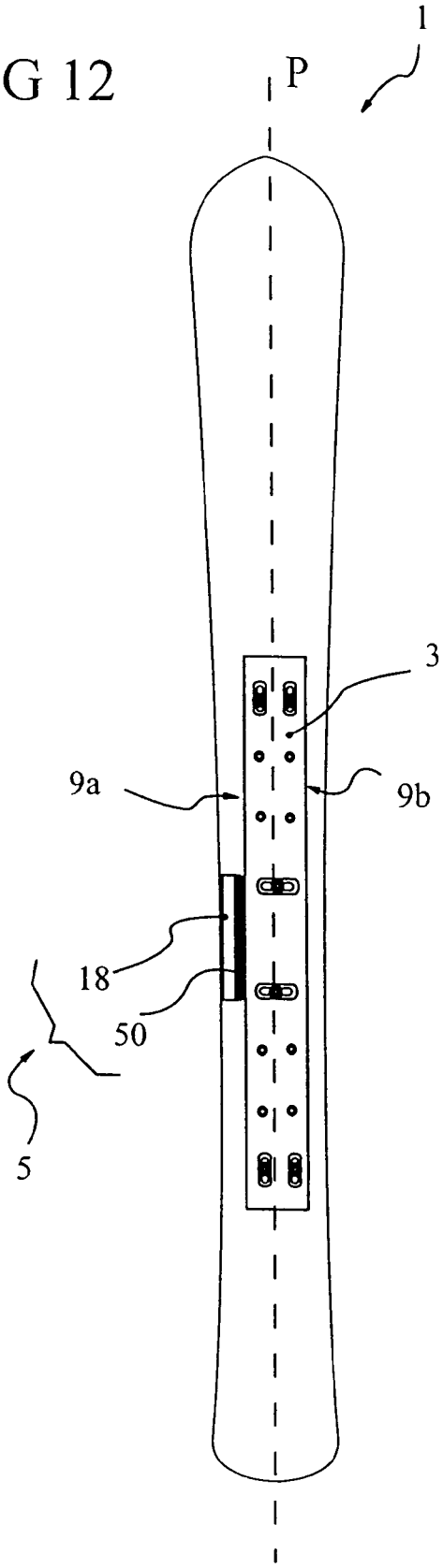
FIG. 12 is a view from above of a ski according to a design variation of the complementary element.

FIG. 12 is a view from above of a ski according to an embodiment variation of the complementary element. According to said variation, the lateral shock-absorbing stop is not fixed by means of cooperation of shape in a complementary element as in the realization modes described above. In this variation, the complementary element (3) is a simple rectangular plate, whose lateral rims are linear, at least the rim in contact with the lateral shock-absorbing stop, while the shock-absorbing stop has also a rectangular shape.

The lateral shock-absorbing stop (5) and/or its shock-absorbing element (50) are made of elastically deformable material, for example, of viscous elastic material, and, for example, of rubber, of synthetic rubber, of visco-elastic rubber, or of any other equivalent or appropriate material. It goes without saying that the lateral shock-absorbing stop (5) and/or its shock-absorbing element (50) could be made of a deformable elastic sheet, made, for example, of metal or realized of a composite material.

Needless to say, the invention is not limited to the specific embodiments described or represented by way of examples, but it includes also all equivalent techniques as well as combinations thereof.

The invention claimed is:

1. A snow sliding board such as a ski, a mono-ski or a snowboard, with a vertical plane of general symmetry, comprising:

a base which includes at least in a mounting zone and a complementary longitudinal element intended to receive a binding for a user's boot; said base having a shape of an elongated beam comprising a sliding sole whose front extremity is raised;

the complementary longitudinal element having the shape of an elongated plate, limited laterally by a lateral internal rim and an external lateral rim, the complementary element also comprising a front portion connected to a rear portion by means of a middle portion, at least one of the lateral rims of the complementary element being laterally supported by at least its middle portion on a lateral shock-absorbing stop made of an elastically deformable material at least one of the lateral edges of the complementary element being laterally engaged in at least the complementary element central portion by a lateral shock-absorbing stop made of an elastically deformable material which permits and elastically damps lateral movement of the complementary element central portion.

2. The snow sliding board according to claim 1, wherein the lateral shock-absorbing stop is fixed on an upper surface of the base.

3. The snow sliding board according to claim 1, wherein the lateral shock-absorbing stop comprises:

a shock-absorbing element sandwiched between one of the lateral rims of the complementary element and a lateral retention projection which is integral with the base.

4. The snow sliding board according to claim 3, wherein the shock-absorbing element of the lateral shock-absorbing stop is an integral part of the lateral retention projection.

5. The snow sliding board according to claim 3, wherein the shock-absorbing element of the lateral shock-absorbing stop is fixed at least at one of the lateral rims of the complementary element.

6. The snow sliding board according to claim 1, wherein at least one of the lateral rims of the complementary element comprises a hollow profile constituting a lesser width in a middle portion of said complementary element, said hollow profile being shaped to cooperate with the lateral shock-absorbing stop.

7. The snow sliding board according to claim 1, wherein the internal lateral rim is laterally supported on the lateral shock-absorbing stop which is arranged on the internal side of the base.

8. The snow sliding board according to claim 1, wherein the front portion of the complementary element is made up of two longitudinal front arms extending from the middle portion toward the front, while the rear portion of the complementary element is made up of two longitudinal rear arms extending from the middle portion toward to the rear.

9. The snow sliding board according to claim 8, wherein the front portion comprises a front internal arm and a front external arm; whereas, the rear portion comprises a rear internal arm and a rear external arm, said front internal arm and said rear internal arm, together with the middle portion, being constructed from a first material; whereas, said front external arm and said rear external arm are constructed from a second material different from the first material.

10. The snow sliding board (1) according to claim 1, wherein the complementary element is joined to the base by fixation elements.

11. A snow sliding board such as a ski, a mono-ski, or a snowboard with a vertical plane of general symmetry, comprising:

a base which includes at least in a binding mounting zone said base having a shape of an elongated beam comprising a sliding sole whose front extremity is raised;

a complementary longitudinal element intended to receive a binding for a user's boot, the complementary longitudinal element being elongated with a lateral inner edge and a lateral outer edge, the complementary element also comprising a front portion connected to a rear portion by a central portion, the front portion and the rear portion of the complementary element being each fixed to the base, such that relative lateral displacements between the front and rear portions of said complementary element and the base are blocked and relative longitudinal displacements are permitted the central portion of the complementary element being fixed at the base such that longitudinal translation of the central portion of the complementary element in relation to the base is blocked and relative transverse displacement is permitted, at least one of the lateral edges of the complementary element being laterally engaged in at least the complementary element central portion by a lateral shock-absorbing stop made of an elastically deformable material which permits and elastically damps lateral movement of the complementary element central portion.

12. The snow sliding board according to claim 11, wherein:

the front portion of the complementary element is fixed to the base by two fixation screws, one front left screw and one front right screw, each screw traversing a corresponding oblong hole, respectively extending longitudinally in an oblong left hole and an oblong right hole;

the rear portion of the complementary element is fixed to the based by two fixation screws, one rear left screw and one front right screw, each of the screws traversing a corresponding oblong hole, respectively extending longitudinally in a left oblong hole and a right oblong hole; and the central portion of the complementary element is fixed by at least one screw traversing a corresponding oblong hole extending transversely.

13. The snow sliding board according to claim 12, wherein the screw which fixes the central portion is positioned at a level of the corresponding oblong hole in order to permit lateral displacement of the central portion toward both sides of the screw.

14. The snow sliding board according to claim 12, wherein the screw which fixes the central portion is in contact with one of the extremities of the oblong holes in order to only permit lateral displacement of the central portion only toward the lateral support.

15. A ski comprising:

an elongated base which is raised at one end and which has an upper surface and a lower, snow-engaging surface;

a complementary longitudinal element mounted to a central portion of the upper surface of the base, the complementary longitudinal element including a forward portion, a rearward portion, and a middle portion, the middle portion being mounted to the base upper surface such that limited lateral movement is permitted;

a resilient shock-absorbing stop disposed on the base upper surface adjacent and abutting the complementary longitudinal element middle portion to limit lateral movement of the middle portion at least one of the lateral edges of the complementary element being laterally engaged in at least the complementary element central portion by a lateral shock-absorbing stop made of an elastically deformable material which permits and elastically damps lateral movement of the complementary element central portion.

* * * * *